US009678464B2

(12) United States Patent
Matsuda et al.

(10) Patent No.: US 9,678,464 B2
(45) Date of Patent: Jun. 13, 2017

(54) SHEET FEEDER, AND IMAGE FORMING APPARATUS USING THE SHEET FEEDER

(71) Applicants: Naoki Matsuda, Kanagawa (JP); Masahiro Ishida, Kanagawa (JP)

(72) Inventors: Naoki Matsuda, Kanagawa (JP); Masahiro Ishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/947,246

(22) Filed: Nov. 20, 2015

(65) Prior Publication Data

US 2016/0170361 A1 Jun. 16, 2016

(30) Foreign Application Priority Data

Dec. 12, 2014 (JP) ..... 2014-252397

(51) Int. Cl.

| | |
|---|---|
| ***G03G 15/00*** | (2006.01) |
| ***B65H 1/26*** | (2006.01) |
| ***B65H 3/00*** | (2006.01) |
| ***B65H 1/04*** | (2006.01) |
| ***B65H 1/00*** | (2006.01) |
| ***G03G 21/16*** | (2006.01) |

(52) U.S. Cl.

CPC ..... *G03G 15/6502* (2013.01); *B65H 1/00* (2013.01); *B65H 1/04* (2013.01); *B65H 1/266* (2013.01); *B65H 3/00* (2013.01); *G03G 21/1638* (2013.01); *G03G 21/1647* (2013.01)

(58) Field of Classification Search

CPC ..... B65H 1/00; B65H 1/04; B65H 2405/114; B65H 2405/113; B65H 2405/112; B65H 2405/31; B65H 2405/32; B65H 2515/32; G03G 2215/00383

USPC ..... 271/162, 163, 164; 399/393

See application file for complete search history.

(56) References Cited

U.S. PATENT DOCUMENTS

| | | | | |
|---|---|---|---|---|
| 2009/0057975 | A1* | 3/2009 | Uchida | B65H 1/26 270/1.01 |
| 2009/0066011 | A1* | 3/2009 | Ohno | B65H 1/266 271/171 |
| 2012/0061907 | A1* | 3/2012 | Matsuyama | B65H 1/266 271/145 |

(Continued)

FOREIGN PATENT DOCUMENTS

| | | |
|---|---|---|
| JP | 2006-256811 | 9/2006 |
| JP | 2010-097036 | 4/2010 |
| JP | 2014-139095 | 7/2014 |

*Primary Examiner* — David H Bollinger

(74) *Attorney, Agent, or Firm* — Harness, Dickey & Pierce, P.L.C.

(57) ABSTRACT

A sheet feeder is provided. The sheet feeder includes a sheet container installation space forming member to form a sheet container installation space in the sheet feeder; a sheet container to contain a recording sheet therein, which can be inserted into or extracted from the sheet container installation space; and a sheet feeding device, which contacts with the recording sheet in the sheet container at a sheet pickup position to apply a feeding power to the recording sheet. The sheet feeder has a passage, which is formed by the sheet container and the sheet container installation space forming member to communicate the inside of the sheet feeder with the outside thereof and which is detoured plural times, wherein the passage is located above the sheet pickup position.

3 Claims, 7 Drawing Sheets

(56) References Cited

U.S. PATENT DOCUMENTS

| | | | | |
|---|---|---|---|---|
| 2014/0117612 | A1* | 5/2014 | Kuroda | B65H 85/00 271/3.19 |
| 2014/0117617 | A1* | 5/2014 | Inoue | B65H 7/20 271/265.01 |
| 2015/0028536 | A1* | 1/2015 | Takai | B65H 3/0684 271/117 |
| 2015/0108713 | A1* | 4/2015 | Yoshitsugu | B65H 31/08 271/217 |
| 2015/0248880 | A1 | 9/2015 | Matsuda et al. | |

* cited by examiner

SHEET FEEDER, AND IMAGE FORMING APPARATUS USING THE SHEET FEEDER

CROSS-REFERENCE TO RELATED APPLICATIONS

This patent application is based on and claims priority pursuant to 35 U.S.C. §119 to Japanese Patent Application No. 2014-252397 filed on Dec. 12, 2014 in the Japan Patent Office, the entire disclosure of which is hereby incorporated by reference herein.

BACKGROUND

Technical Field

This disclosure relates to a sheet feeder to feed a recording sheet, and to an image forming apparatus using the sheet feeder.

Description of the Related Art

In sheet feeders of conventional image forming apparatus, which feed recording sheets such as recording paper sheets from a sheet tray, a space is typically formed around the sheet tray (sheet cassette) to prevent occurrence of a problem such that when the sheet tray is attached to or detached from the main body of the image forming apparatus, the sheet tray is contacted with a part serving as an edge of the tray installation space of the main body, which the sheet tray is detached from or attached to, thereby deteriorating the performance of the tray attaching and detaching operations.

There is a proposal in which a bend forming part is used as the part serving as the edge of the tray installation opening or the front portion (in the tray detaching direction) of the sheet tray is bent, so that the space (i.e., passage), which is formed between the edge of the tray installation opening and the sheet tray to communicate the inside of the image forming apparatus with the outside thereof, is bent plural times in attempting to prevent leakage of sounds from the image forming apparatus while maintaining good sheet tray attaching and detaching operability.

SUMMARY

As an aspect of this disclosure, a sheet feeder is provided which includes a sheet container installation space forming member to form a sheet container installation space, a sheet container to contain a recording sheet therein and which can be inserted into the sheet container installation space, and a sheet feeding device, which contacts with the recording sheet in the sheet container at a sheet pickup position to apply a feeding power to the recording sheet. When the sheet feeder is inserted into the sheet container installation space, the sheet feeder has a passage, which is formed by the sheet container and the sheet container installation space forming member to communicate the inside of the sheet feeder with the outside thereof and which is detoured plural times, wherein the passage is located above the sheet pickup position.

As another aspect of this disclosure, an image forming apparatus is provided which includes an image forming portion to form an image on a recording sheet, and the sheet feeder mentioned above which feeds the recording sheet to the image forming portion.

The aforementioned and other aspects, features and advantages will become apparent upon consideration of the following description of the preferred embodiments taken in conjunction with the accompanying drawings.

DETAILED DESCRIPTION

In sheet feeders, when a sheet feeding roller rubs the surface of a recording sheet (such as paper sheet) to feed the recording sheet, a sound (hereinafter referred to as a rubbing sound) is generated at the contact point of the sheet feeding roller with the recording sheet (i.e., the contact point is the sound source). The proposal mentioned above does not describe the positional relationship between the passage bent plural times and the sound source generating sounds to be prevented from leaking. Therefore, there is a possibility that leakage of the sounds generated by the sound source in the sheet feeder is not effectively prevented by the passage bent plural times.

The object of this disclosure is to provide a sheet feeder, which can effectively prevent leakage of sounds generated by a sound source using a passage detoured plural times while maintaining good sheet tray attaching and detaching operability.

Hereinafter, an electrophotographic copier (hereinafter referred to as a copier 500), which is an example of the image forming apparatus according to an embodiment of this disclosure, will be described. Although the copier is a monochromatic image forming apparatus, but the image forming apparatus of this disclosure is not limited thereto. The image forming apparatus of this disclosure also includes a color image forming apparatus such as multi-color or full color image forming apparatus.

Initially, the configuration of the copier 500 will be described.

Figure 2:
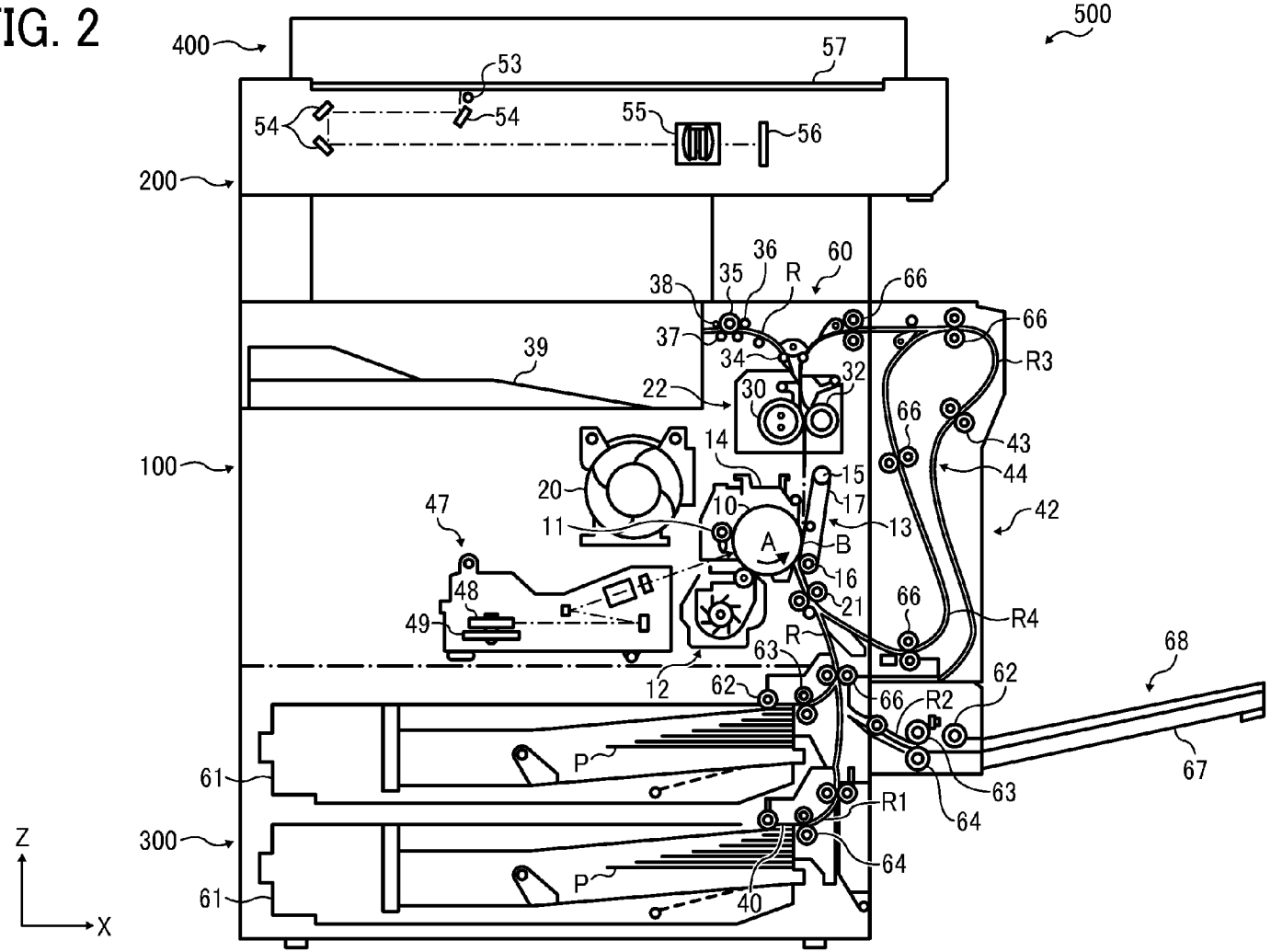
FIG. 2 is a schematic view illustrating a copier as an example of an image forming apparatus according to an embodiment of this disclosure.

FIG. 2 is a schematic view illustrating the entirety of the copier 500. Referring to FIG. 2, the copier 500 includes an image forming portion 100, a scanner 200 which serves as an image reader and is arranged above the image forming portion 100, and a sheet feeder 300 above which the image forming portion 100 is arranged. In addition, the copier 500 includes an automatic document feeder 400 which is arranged above the scanner 200. The automatic document feeder 400 is rotatable on a support located at the backside of the copier 500 in a Y direction (FIG. 2 illustrates the copier 500 from the front side of the copier in the Y direction). The image forming portion 100 includes a drum-shaped photoconductor 10 serving as a latent image bearer.

Figure 3:
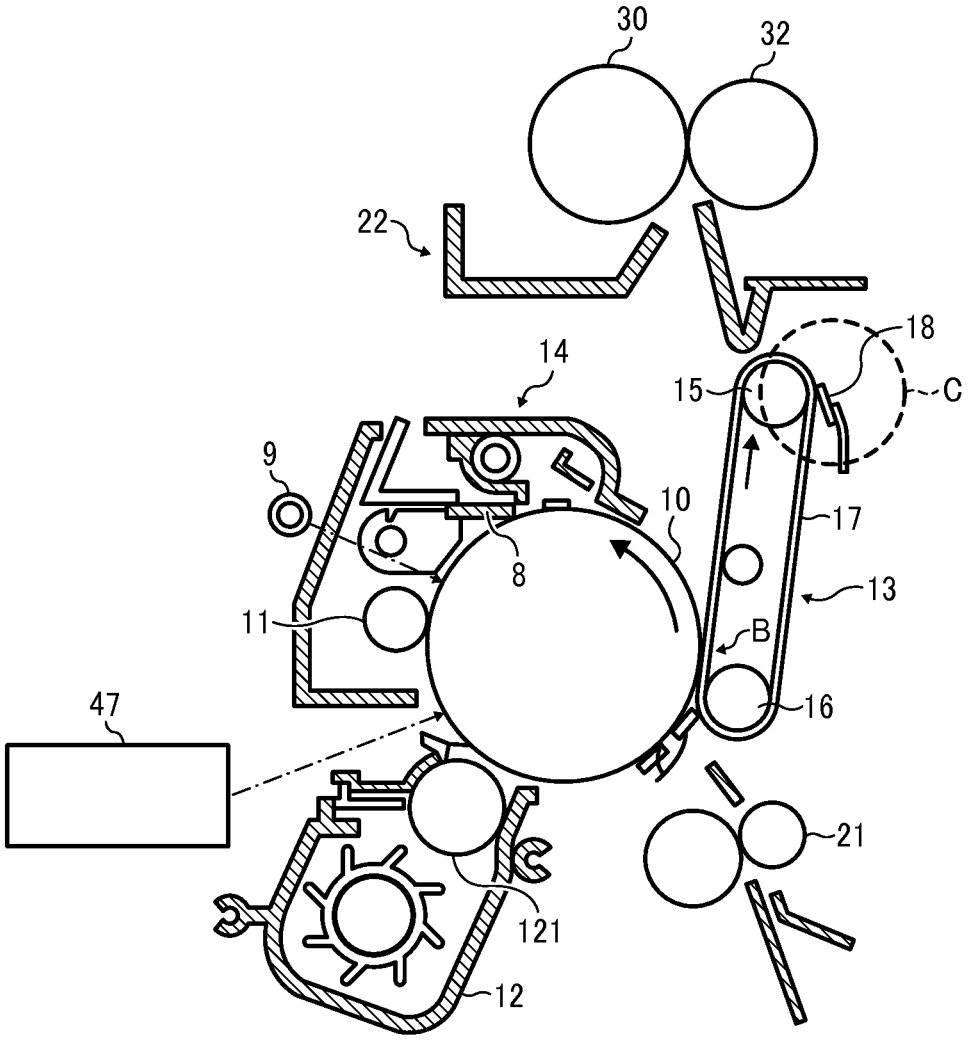
FIG. 3 is a schematic view illustrating a photoconductor of the copier and the vicinity thereof.

FIG. 3 is a schematic view illustrating the photoconductor 10 of the copier 500 and the vicinity thereof. As illustrated in FIG. 3, a discharging lamp 9, a charger 11 using a charging roller, a developing device 12, a transferring unit 13, and a cleaner 14 using a photoconductor cleaning blade 8 are arranged around the photoconductor 10. The developing device 12 uses a polymerized toner as the toner, and adheres the polymerized toner to an electrostatic latent image on the photoconductor 10 using a developing roller 121, which serves as a developer bearer, to visualize the electrostatic latent image.

The transferring unit 13 includes a transfer belt 17 looped over two rollers, i.e., a first belt stretching roller 15 and a second belt stretching roller 16. The transfer belt 17 is contacted with a surface of the photoconductor 10 at a transfer position B at which a toner image on the surface of the photoconductor 10 is transferred to a recording sheet P (illustrated in FIG. 2) such as a paper sheet.

Foreign materials (such as residual toner and paper dust) remaining on the surface of the transfer belt 17 even after the recording sheet P is separated from the transfer belt 17 are scraped off the transfer belt by a belt cleaning blade 18, which is arranged at a transfer belt cleaning position C and which is contacted with the first belt stretching roller 15 with the transfer belt 17 therebetween.

Referring back to FIG. 2, the image forming portion 100 further includes a toner supplier 20 which is arranged at the left side of the charger 11 and the cleaner 14 to supply fresh toner to the developing device 12.

The image forming portion 100 further includes a sheet feeding device 60 which feeds the recording sheet P, which has been fed from a sheet cassette 61 of the sheet feeder 300, to an ejected sheet stacking portion 39 through the transfer position B. The sheet feeding device 60 feeds the recording sheet P along a sheet supplying path R1 or a manual sheet supplying path R2, and a sheet feeding path R. A pair of registration rollers 21 is arranged at an upstream side of the sheet feeding path R from the transfer position B relative to the sheet feeding direction.

A heat fixing device 22 is arranged at a downstream side of the sheet feeding path R from the transfer position B relative to the sheet feeding direction. The heat fixing device 22 includes a heating roller 30 serving as a heating member, and a pressing roller 32 serving as a pressing member. The heating roller 30 and the pressing roller 32 sandwich the recording sheet P to fix the toner image on the recording sheet P upon application of heat and pressure thereto.

A bifurcating claw 34, a sheet ejecting roller 35, a first pressing roller 36, a second pressing roller 37, a stiffness imparting roller 38, and the ejected sheet stacking portion 39 to stack the recording sheets bearing fixed images thereon are arranged at downstream sides of the sheet feeding path R from the heat fixing device 22 relative to the sheet feeding direction.

The image forming portion 100 further includes a switch-back device 42, which is arranged at a right side of the image forming portion 100. The switchback device 42 includes a reversal path R3 which is separated from the sheet feeding path R at the bifurcating claw 34 and is connected with a sheet re-feeding path R4 which is connected with the pair of registration rollers 21 so that the recording sheet P bearing the fixed image on one side thereof and entering the reversal path R3 is fed again to the pair of registration rollers 21 along the sheet re-feeding path R4. A pair of switchback rollers 43 is provided on the reversal path R3, and plural pairs of sheet feeding rollers 66 are provided on the sheet re-feeding path R4.

As illustrated in FIG. 2, the image forming portion 100 includes a laser writing device 47 which is arranged at a left side of the developing device 12. The laser writing device 47 includes a scanning optical system including a laser light source, a polygon mirror 48 serving as a scanning rotatable multi-part mirror, a polygon motor 49, an fθ lens, etc.

The scanner 200 includes a light source 53, plural mirrors 54, a focusing lens 55, an image sensor 56 such as CCD image sensors, etc. A contact glass 57, on which a document is set to be scanned, is provided on the upper surface of the scanner 200.

The automatic document feeder 400 includes a document setting table, and a document stacking table on which a document read and ejected is stacked. The automatic document feeder 400 includes plural document feeding rollers which feed a document from the document setting table to the document stacking table via the document reading position on the contact glass 57.

The sheet feeder 300 includes the sheet cassette 61 containing a recording sheet such as paper sheets and overhead projection (OHP) film sheets therein. A sheet feeding roller 62, a roller receiving plate 40, a sheet supplying roller 63, and a separating roller 64 are provided on the sheet cassette 61. The sheet feeding roller 62 contacts the uppermost recording sheet of a bundle of recording sheets P in the sheet cassette 61 to apply a feeding power to the recording sheet.

As illustrated in FIG. 2, the image forming portion 100 includes a manual sheet feeding device 68 which is arranged at a right side of the copier 500. The manual sheet feeding device 68 includes a manual feed tray 67 which can be opened and closed, and the manual sheet supplying path R2 along which the recording sheet P set on the manual feed tray 67 is fed to the sheet feeding path R. Similarly to the sheet cassette 61, the manual sheet feeding device 68 includes the sheet feeding roller 62, the sheet supplying roller 63, and the sheet separating roller 64.

Next, the operation of the copier 500 will be described.

When a copy is produced using the copier 500, initially a main switch of the copier is turned on, and a document to be copied is set on the document setting table of the automatic document feeder 400. When the document has a book form, the automatic document feeder 400 is opened, and the page of the book to be copied is directly set on the contact glass 57 of the scanner 200, followed by closing the automatic document feeder 400 to cover the book.

Thereafter, a start switch of the copier 500 is pushed. In this regard, in the case in which the document is set on the automatic document feeder 400, the document is fed to the contact glass 57 by the document feeding rollers, and then the scanner 200 is driven. After the scanner 200 reads the image of the document, the document is ejected to the document stacking table. In the case in which the document is directly set on the contact glass 57, the scanner 200 is driven at once to read the image of the document.

When the image of the document is read, the scanner 200 moves the light source 53 along the contact glass 57. In this regard, the light source 53 irradiates the document on the contact glass 57 with light, and the reflected light is guided to the focusing lens 55 by the plural mirrors 54 so that the reflected light enters into the image sensor 56. Thus, the image sensor 56 reads the image of the document.

While reading the image of the document, the copier 500 rotates the photoconductor 10 in a direction A using a photoconductor driving motor. The charger 11 evenly charges the surface of the photoconductor 10 so that the surface of the photoconductor has a potential of −100 v, for example. Next, the laser writing device 47 irradiates the charged surface of the photoconductor 10 with laser light according to the image data of the document read by the scanner 200, thereby forming an electrostatic latent image on the surface of the photoconductor 10. Specifically, the potential of the irradiated portion of the photoconductor 10 is changed, for example, to a potential of from 0V to −100V. The developing device 12 develops the electrostatic latent image with a toner, thereby forming a visible image (i.e., toner image) on the surface of the photoconductor 10.

At the same time when the start switch is pushed, the sheet feeding roller 62 feeds the recording sheets P in the sheet cassette 61 of the sheet feeder 300 one by one when plural copiers are produced. The sheet supplying roller 63 and the sheet separating roller 64 feeds the recording sheets P while separating the recording sheets one by one. First one of the recording sheets P is fed to the sheet supplying path R1, and the recording sheet P is guided to the sheet feeding path R by the pairs of sheet feeding rollers 66. When the recording sheet P thus guided to the sheet feeding path R strikes the pair of registration rollers 21, the recording sheet P is stopped by the pair of registration rollers.

In the case in which the manual sheet feeding device 68 is used, the manual feed tray 67 is opened and one or more of the recording sheet P are set thereon. Similarly to the case mentioned above, the recording sheet P (one of the recording sheets) set on the manual feed tray 67 is fed to the sheet supplying path R2 by the sheet feeding roller 62, the sheet supplying roller 63 and the sheet separating roller 64, and the recording sheet P is guided to the sheet feeding path R by the pairs of sheet feeding rollers 66. When the recording sheet P thus guided to the sheet feeding path R strikes the pair of registration rollers 21, the recording sheet P is stopped by the pair of registration rollers.

The recording sheet P thus stopped by the pair of registration rollers 21 is fed to the transfer position B by the pair of registration rollers 21, which is timely rotated so that the toner image on the photoconductor 10 can be transferred to a proper position of the recording sheet P at the transfer position B.

Since the transferring unit 13 transfers the toner image on the photoconductor 10 to the recording sheet P, which is fed to the transfer position B, the recording sheet P bears the toner image thereon. After the toner image is transferred, toner remaining on the surface of the photoconductor 10 is removed therefrom by the cleaner 14, and charges remaining on the photoconductor 10 are removed by the discharging lamp 9 (illustrated in FIG. 3) to an extent such that the surface of the photoconductor 10 has a reference potential of from 0V to −150V. Thus, the photoconductor 10 can be ready for the next image forming operation beginning with the charging operation using the charger 11.

The transfer belt 17 feeds the recording sheet P bearing the toner image thereon to the heat fixing device 22, and the heating roller 30 and the pressing roller 32 of the heat fixing device 22 heat and press the recording sheet P while sandwiching the recording sheet, thereby fixing the toner image to the recording sheet P. The recording sheet P bearing the fixed toner image thereon is then ejected from the image forming portion 100 while stiffened by the sheet ejecting roller 35, the first pressing roller 36, the second pressing roller 37, and the stiffness imparting roller 38 so that the recording sheet P is stacked on the ejected sheet stacking portion 39.

When another image is formed on the backside of the recording sheet P (i.e., duplex printing is performed), the bifurcating claw 34 is switched to feed the recording sheet P bearing the fixed toner image on one side thereof to the reversal path R3. After the recording sheet P in the reversal path R3 is fed to a switchback position 44 by the pair of sheet feeding rollers 66, the recording sheet P is fed back by the pair of switchback rollers 43 so as to enter into the sheet re-feeding path R4, and the recoding sheet P is then fed again to the sheet feeding path R by the pairs of sheet feeding rollers 66. Similarly to the image forming operation mentioned above, another toner image is transferred to the backside of the recoding sheet P at the transfer position B, and is then fixed to the backside by the heat fixing device 22. The recording sheet P bearing the fixed toner images on both sides thereof is then ejected from the image forming portion 100 so as to be stacked on the ejected sheet stacking portion 39.

Figure 4:
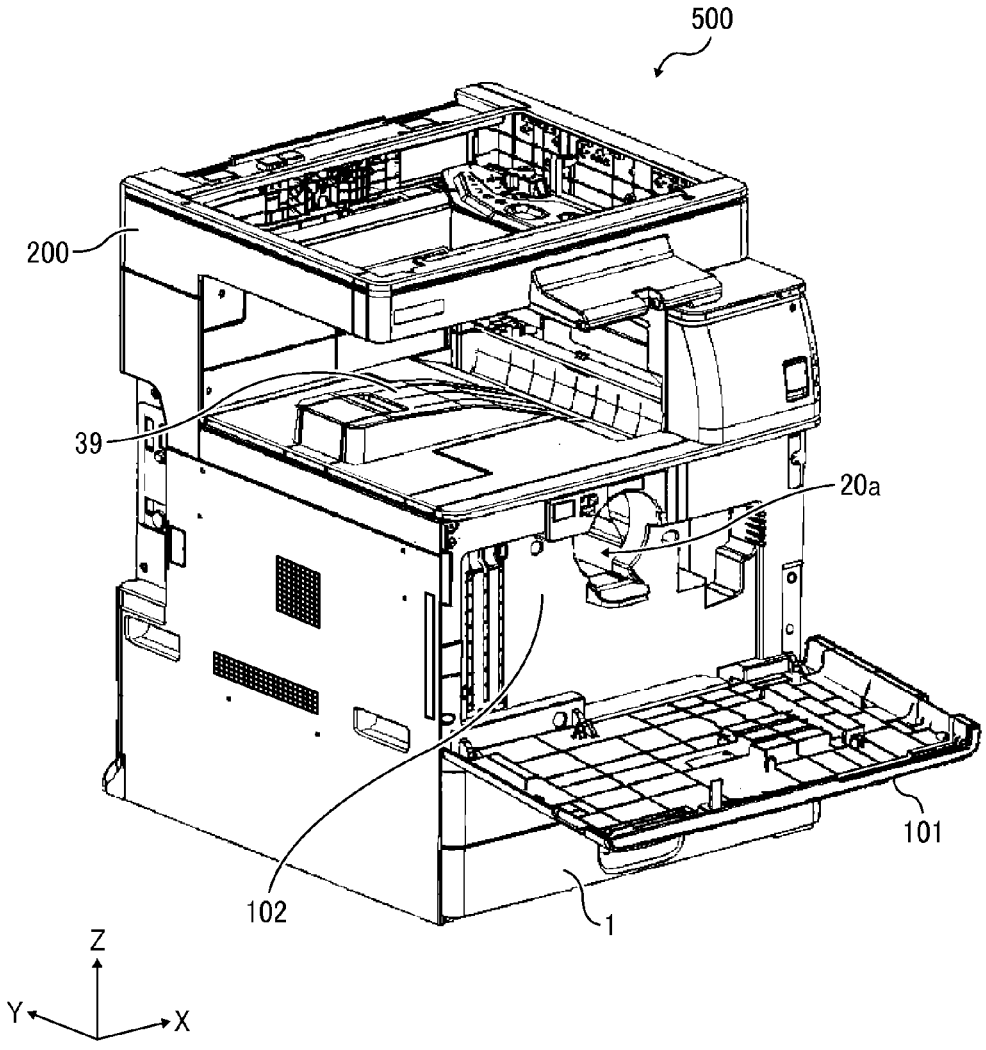
FIG. 4 is a schematic perspective view illustrating the copier, whose front cover is opened.

FIG. 4 is a schematic perspective view illustrating the copier, whose front cover 101 is opened. In this regard, the automatic document feeder 400 and the optical system of the scanner 200 are not illustrated in FIG. 4.

As illustrated in FIG. 4, by opening the openable and closable front cover 101 serving as an exterior cover, an inner cover 102 serving as an interior cover becomes exposed. In FIG. 4, a toner bottle of the toner supplier 20 is not illustrated, and a bottle setting opening 20*a* of the inner cover 102, through which the toner bottle is to be inserted, is illustrated.

In addition, a cassette exterior cover 1 equipped with a handle, by which the sheet cassette 61 can be detached from the copier 500, is arranged below the openable and closable front cover 101.

Figure 5A:
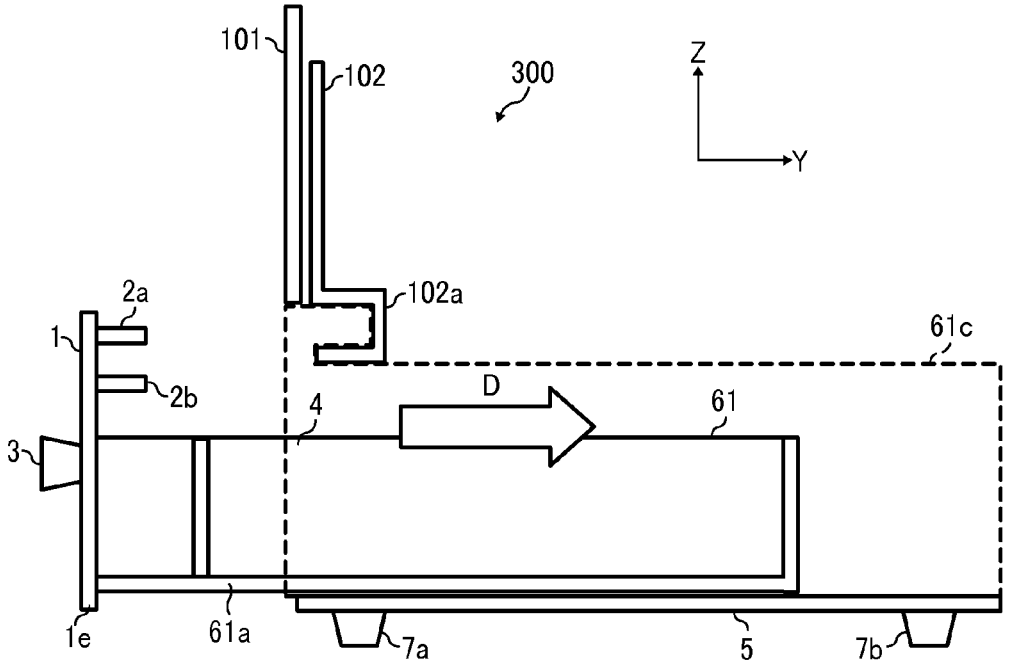
FIG. 5A is a schematic side view illustrating a sheet cassette of the sheet feeder in the process of insertion to a main body of an image forming apparatus.
Figure 5B:
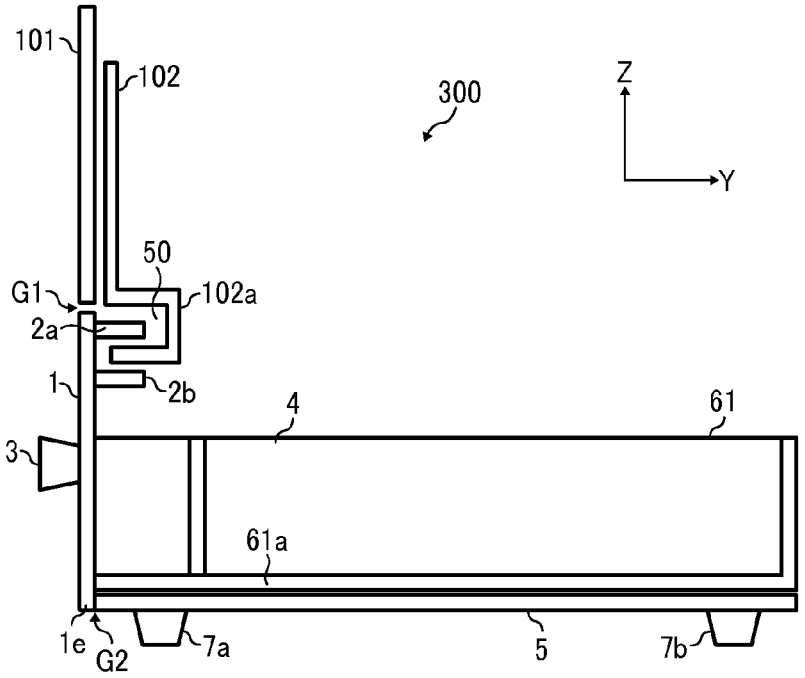
FIG. 5B is a schematic side view illustrating the sheet cassette completely inserted to the main body of the image forming apparatus.
Figure 6:
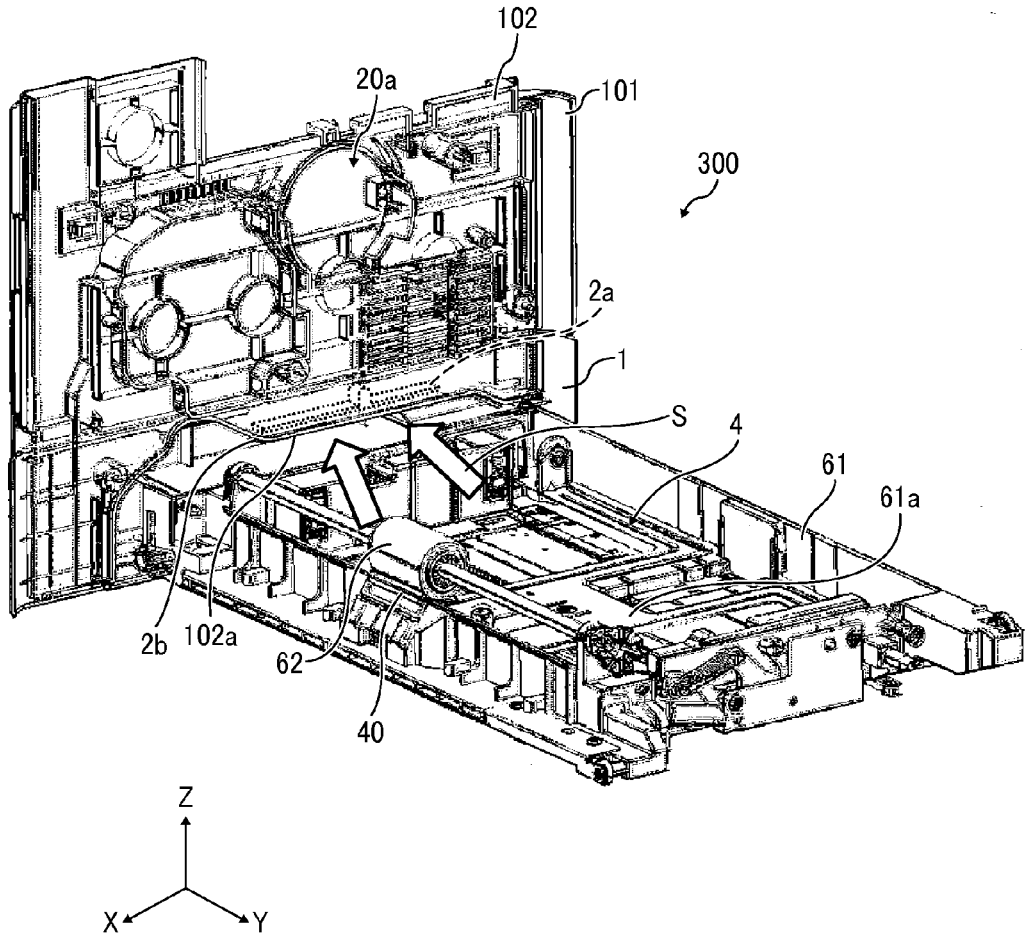
FIG. 6 is a schematic perspective view illustrating the sheet feeder.

FIGS. 5A and 5B are schematic side views illustrating the sheet feeder 300 of the copier 500 from the right side of the copier illustrated in FIG. 2. FIG. 5A is a schematic side view illustrating the sheet cassette 61 in the process of insertion to the main body of the copier 500, and FIG. 5B is a schematic side view illustrating the sheet cassette 61 completely inserted to the main body of the copier 500. In FIGS. 5A and 5B, the sheet feeding roller 62 and the roller receiving plate 40 are not illustrated. FIG. 6 is a schematic perspective view illustrating the sheet feeder 300 when the copier 500 illustrated in FIG. 2 is observed from the inner right side thereof.

Figure 1:
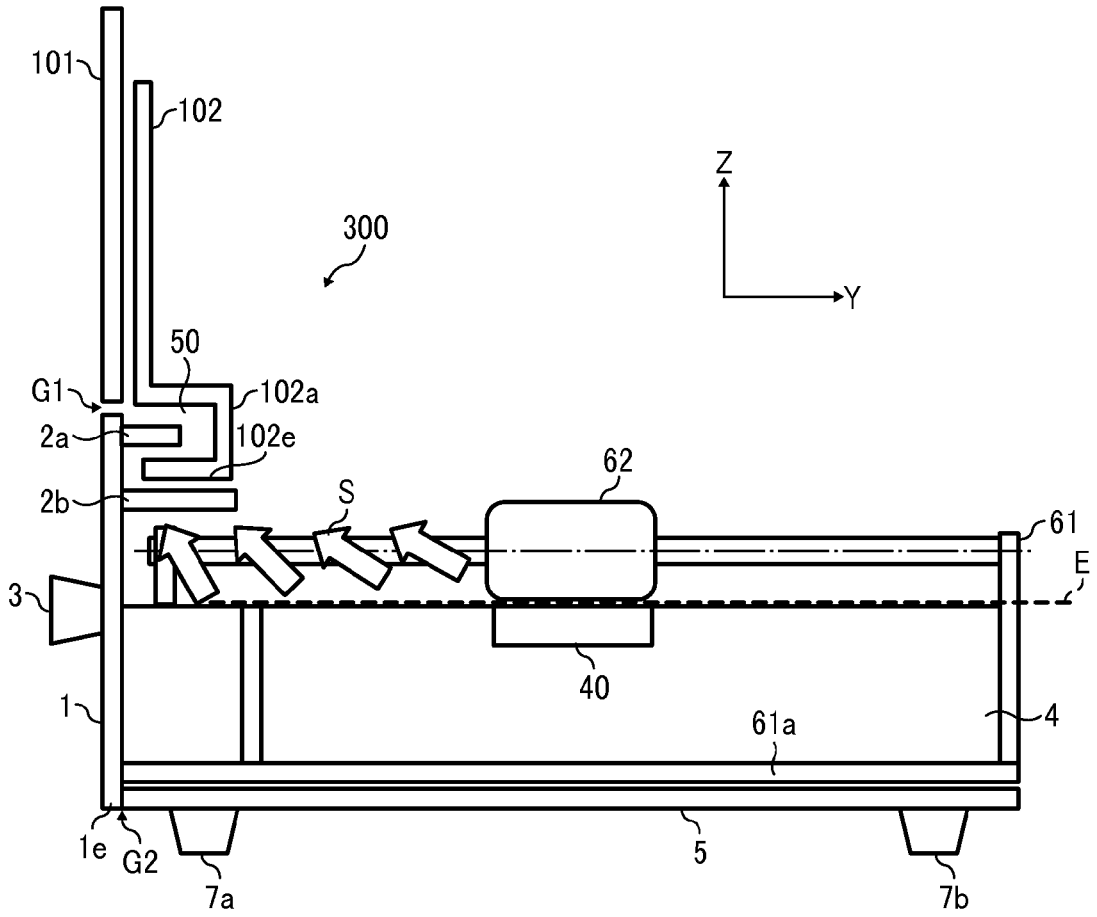
FIG. 1 is a schematic side view illustrating a sheet feeder according to an embodiment of this disclosure, which is attached to a main body of an image forming apparatus.

FIG. 1 is a schematic side view of the sheet feeder 300 in which the sheet cassette 61 is completely inserted to the main body of the copier 500. The sheet feeding roller 62 and the roller receiving plate 40 are illustrated in FIG. 1.

As illustrated in FIGS. 5A and 5B, the sheet feeder 300 includes the sheet cassette 61, which can contain a bundle of recording sheets P in a sheet containing portion 4 and which can be detachably attached to the main body of the copier 500. In addition, the sheet feeder 300 includes the cassette exterior cover 1 which is fixed to the sheet cassette 61 to cover the front edge of the sheet cassette in the cassette detaching direction when the sheet cassette is completely inserted into the main body. Further, the sheet feeder 300 includes the inner cover 102 and a lower frame 5, which form a sheet container installation space 61*c* into which the sheet cassette 61 is inserted to be attached to the main body of the copier 500. The upper edge and the side edges of the sheet container installation space 61*c* are formed by the inner cover 102, and the lower edge of the space is formed by the lower frame 5.

The sheet cassette 61 has a handle 3 on the surface of the cassette exterior cover 1. By pulling the handle 3, the sheet cassette 61 can be drawn from the main body of the copier 500. In this case, the sheet containing portion 4 becomes exposed, and therefore the recording sheets P can be supplied to the sheet containing portion 4. In addition, by pushing the drawn sheet cassette 61 in such a direction D as illustrated in FIG. 5A, the sheet cassette 61 can be completely inserted to the sheet container installation space 61*c* so as to be attached to the main body of the copier 500 as illustrated in FIG. 5B or FIG. 1.

The copier 500 has a main body frame serving as a chassis, which supports the parts of the copier and which is made of a metal such as aluminum. In FIGS. 1, 5A and 5B, only the lower frame 5, which also serves as the lower end surface of the sheet feeder 300, is illustrated as a part of the main body frame. The lower frame 5 has rubber legs 7 (7*a* and 7*b*) on the lower surface thereof.

The cassette exterior cover 1 has exterior ribs, i.e., an upper exterior rib 2*a* and a lower exterior rib 2*b*, which are arranged on upper portions of the cover while extending toward the inside of the copier 500 and which serve as a first projecting portion. The lower end of the inner cover 102, which is located below the lower end of the openable and closable front cover 101, has an exterior rib-facing portion 102*a* which surrounds the upper exterior rib 2*a* from three directions and which serves as a second projecting portion. A lower surface 102*e* of the exterior rib-facing portion 102*a* and the upper surface of the lower frame 5 form the sheet cassette installation space 61*c*, and the sheet cassette 61 is inserted into the sheet cassette installation space so as to be attached to the main body of the copier 500 through. Namely, the lower surface 102*e* of the exterior rib-facing portion 102*a* and the upper surface of the lower frame 5 are edges of the sheet cassette installation space 61*c*.

As illustrated in FIGS. 1 and 5B, when the sheet cassette 61 is completely inserted into the sheet cassette installation space 61*c* so as to be attached to the main body of the copier 500, the surfaces of the upper and lower exterior ribs 2*a* and 2*b* and the surface of the exterior rib-facing portion 102*a* are opposed to each other without contact, and therefore a space 50, which is part of the sheet cassette installation space 61*c*, is formed. In the space 50, the space formed by the upper surface of the lower exterior rib 2*b* and the lower surface of the exterior rib-facing portion 102*a* is also a space formed by the edge of the main body of the copier 500 and the sheet cassette 61. In this regard, the passage extending from the inside of the cassette exterior cover 1 to the outside thereof through the space 50 is the above-mentioned passage detoured plural times.

In the sheet feeder 300, rubbing sounds are generated by the sheet feeding roller 62 and the recording sheet P, and in addition rubbing sounds are formed by the uppermost recording sheet of a bundle of the recording sheets P in the sheet cassette 61 and the upper second recording sheet when the uppermost recording sheet is fed by the sheet feeding roller 62. In this regard, it is possible that these sounds leak from the sheet feeder 300 and bring a discomfort feeding to the people near the sheet feeder 300. The cassette exterior cover 1 spatially separating the inside of the sheet feeder 300 from the outside thereof can prevent leakage of the sounds from the inside of the sheet feeder 300 to the outside thereof to an extent, thereby making it possible to reduce noise.

As illustrated in FIGS. 1 and 5B, the space 50 formed between the cassette exterior cover 1 and the inner cover 102 has a labyrinth structure having plural detoured portions. Therefore, sounds generated inside the sheet feeder 300 cannot travel to the outside thereof without plural diffractions (and reflections or the like). Since sounds decay at every diffraction (and reflection), the sounds leaking to the outside of the sheet feeder 300 can be minimized by diffracting (and reflecting) the sounds plural times.

Since a space is formed between the cassette exterior cover 1 and the inner cover 102, contact of the cassette exterior cover 1 with the inner cover 102 can be prevented (i.e., deterioration of attaching and detaching operability of the cassette can be prevented) when the sheet cassette 61 is attached to or detached from the main body of the copier 500.

In addition, since a space is formed between cassette exterior cover 1, and the inner cover 102 and the openable and closable front cover 101, air can be flowed from the inside of the sheet feeder 300 to the outside thereof. Therefore, it becomes possible to prevent increase of the inner temperature of the sheet feeder 300 while preventing leakage of the sounds generated inside the sheet feeder 300.

Specifically, among sounds generated in an inner portion from the cassette exterior cover 1, a sound travelling into the space between the lower surface of the exterior rib-facing portion 102*a* and the upper surface of the lower exterior rib 2*b* can travel to the outside of the cassette exterior cover 1 through the space 50. In this regard, the sound travelling into the space between the lower surface of the exterior rib-facing portion 102*a* and the upper surface of the lower exterior rib 2*b* passes through the space, and strikes the inner surface of the cassette exterior cover 1, and the sound causes diffraction, reflection and the like so that part of the sound travels upward. The sound travelling upward strikes the lower surface of the upper exterior rib 2*a*, and the sound causes diffraction, reflection and the like so that part of the sound travels horizontally (i.e., rightward in FIGS. 1 and 5B).

The sound thus diffracted and reflected, and travelling horizontally strikes the side surface of the exterior rib-facing portion 102*a*, and is diffracted and reflected so that part of the sound travels upward. The sound thus diffracted and reflected, and travelling upward strikes the lower surface of a portion of the exterior rib-facing portion 102*a*, which portion is located above the exterior rib 2*a*, and is diffracted and reflected so that part of the sound travels horizontally (i.e., leftward in FIGS. 1 and 5B). The sound thus diffracted and reflected, and travelling horizontally passes through a space between the upper surface of the exterior rib 2*a* and the lower surface of the portion of the exterior rib-facing portion 102*a*, and part of the sound exits the cassette exterior cover 1 through the gap between the openable and closable front cover 101 and the cassette exterior cover 1.

As mentioned above, sounds decay at every diffraction and reflection. Since the sheet feeder 300 has a configuration such that sounds generated inside the sheet feeder 300 cannot exit the sheet feeder without plural diffractions and reflections, leakage of the sounds from the sheet feeder can be prevented. In addition, since air can pass through the space 50, it is possible to discharge hot air in the sheet feeder 300 to the outside thereof or to introduce cool air outside the sheet feeder 300 into the inside thereof, thereby making it possible to prevent increase of the inner temperature of the sheet feeder 300. Thus, it becomes possible to prevent leakage of sounds from the sheet feeder 300 while preventing increase of the inner temperature of the sheet feeder 300.

As illustrated in FIGS. 1 and 5B, the detoured passage formed by the space 50 has four detoured portions at which sounds are diffracted and reflected. A detoured passage having three or more detoured portions can reduce leakage of noise from the sheet feeder 300 more effectively than a detoured passage having one or two detoured portions.

In addition, such a detoured passage as having one or two detoured portions has a drawback such that when one of parts (such as the exterior ribs 2*a* and 2*b* and the exterior rib-facing portions 102*a*) forming the space 50 is deformed by receiving a force, the passage cannot maintain the sound diffracting form, and therefore it becomes possible that the passage cannot maintain good noise leakage preventing effect. In contrast, in a detoured passage having three or more detoured portions, the sound exiting the sheet feeder 300 is a sound diffracted three or more times. Therefore, the passage having such a configuration can maintain the sound diffracting form (i.e., the passage can maintain good noise leakage preventing effect) even when one of the parts forming the space 50 is deformed to a certain degree.

In FIG. 1, a broken line E represents a position (hereinafter referred to as a recording sheet pickup position) at which the sheet feeding roller 62 is contacted with the recording sheet P. As illustrated in FIGS. 1 and 6, the detoured passage formed in the space 50 is located above the recording sheet pickup position E.

The sheet feeder 300 feeds the recording sheet P to the image forming portion 100 so that the recording sheet P passes through the nip between the sheet feeding roller 62 and the roller receiving plate 40. Therefore, the sound caused by picking up the uppermost recording sheet P with the sheet feeding roller 62 and the sound caused by rubbing the picked up uppermost recording sheet P with the upper second recording sheet P are main noise sources of the sheet feeder 300.

Since the position at which the uppermost recording sheet and the upper second recording sheet are rubbed with each other is located below the recording sheet pickup position E, the rubbing sound generating position is located below the recording sheet pickup position E in FIG. 1. In the sheet feeder 300 according to an embodiment of this application, the detoured passage is formed in the space 50 at a position above the rubbing sound generating position and the recording sheet pickup position. In this regard, the sounds generated at the rubbing sound generating position and the recording sheet pickup position travel in directions indicated by arrows S in FIGS. 1 and 6. As illustrated in FIGS. 1 and 6, it is considered that the rubbing sound and the recording sheet pickup sound travel upward and hardly travel downward. The reason therefor is considered to be the following.

Specifically, the rubbing sound and the recording sheet pickup sound are generated at the uppermost portion of the bundle of recording sheets P or at a position higher than the position. Since the bundle of recording sheets P and a cassette bottom plate 61*a* are present below these sound generating positions, transmission of the sounds is prevented thereby. In contrast, since there is no bundle of recording sheets and plate (such as cassette bottom plate 61*a*) above the sheet pickup position E, transmission of the sounds is not prevented. Therefore, it is considered that the rubbing sound and the recording sheet pickup sound travel upward with hardly travelling downward.

Since the rubbing sound and the recording sheet pickup sound hardly travel downward, the sounds hardly leak even when a space is formed between the parts (i.e., the sheet container installation space forming member such as the inner cover 102 and the openable and closable front cover 101), which form the sheet container installation space 61*c*, and the cassette exterior cover 1. Namely, even when a detoured passage is also formed between the parts forming the sheet container installation space 61*c* and the cassette exterior cover 1 at a position of the sheet feeder 300 lower than the sound generating positions, the noise leakage preventing effect is hardly produced while the processing cost increases.

Since sounds travel above the sheet pickup position E, the sounds leak when there is a space between the parts forming the sheet container installation space 61*c* and the cassette exterior cover 1.

In the sheet feeder 300, a detoured passage having a labyrinth structure is formed in the space 50 located above the sheet pickup position E, and therefore the sounds generated in the sheet cassette 61 leak from the sheet feeder after being decayed by the labyrinth structure.

Thus, by forming a detoured passage in the space 50, which space easily transmits sounds without such a detoured passage, leakage of the sounds can be effectively prevented. Namely, a good sound leakage preventing effect, which is worth the cost of making such a detoured passage in the space 50, can be produced.

As illustrated in FIG. 1, the upper and lower exterior ribs 2*a* and 2*b* extend in such a direction as to be perpendicular to the surface of the cassette exterior cover 1, and have a function of reinforcing the cassette exterior cover 1. Since the exterior ribs 2*a* and 2*b* have a function of reinforcing the cassette exterior cover 1 while forming the labyrinth structure, the manufacturing cost can be reduced so as to be lower than in a case in which plural ribs are formed for reinforcing the cassette exterior cover 1 and other ribs are formed for forming the labyrinth structure.

In addition, as illustrated in FIG. 1, the projecting portion of the lower exterior rib 2*b* is longer than that of the upper exterior rib 2*a* so that sounds can be diffracted and reflected more securely, thereby enhancing the sound decaying effect of the detoured passage.

In the sheet feeder 300 in which the sheet cassette 61 is completely inserted to the main body of the copier 500 as illustrated in FIGS. 1 and 5B (i.e., the sheet container installation space 61*c*), the size of the space 50 is determined as follows.

Specifically, when the sheet cassette 61 is inserted to the main body of the copier 500 by an excessively large force, the cassette exterior cover 1 striking the frame of the main body is elastically deformed, and therefore the tip of the upper exterior rib 2*a* moves to an inner position closer to the exterior rib-facing portions 102*a* (i.e., moves rightward in FIG. 1) by a certain length (hereinafter referred to as a push-in length). In this regard, it is not preferable that the tip of the upper exterior rib 2*a* is contacted with the exterior rib-facing portions 102*a*, and therefore the length of the space 50 in the Y direction is set so as to be longer than the push-in length.

The push-in length is determined based on the position to which the tip of the exterior rib 2*a* reaches when the cassette exterior cover 1 is pushed so as to be maximally deformed elastically. When the cassette exterior cover 1 is deformed to an extent greater than the maximum deformation amount, the cassette exterior cover 1 is plastically deformed, resulting in destruction of the cassette exterior cover. In this case, the sheet cassette 61 cannot be used thereafter, and therefore it is not necessary to consider such a case. When the deformation amount of the cassette exterior cover 1 is not greater than the maximum deformation amount, the cassette exterior cover 1 is not destroyed and the sheet cassette 61 can be used thereafter.

As mentioned above, the length of the space 50 in the Y direction in FIG. 1 is set so as to be longer than the push-in length which is determined based on the position to which the tip of the exterior rib 2*a* reaches when the cassette exterior cover 1 is maximally deformed elastically. By thus setting the length of the space 50, contact of the upper exterior rib 2*a* with the exterior rib-facing portion 102*a* can be prevented even when the cassette exterior cover 1 is maximally deformed elastically (i.e., even when the cover is deformed to the maximum extent such that the cover can be used thereafter without any problem). In this regard, it is preferable to consider variation in size and arrangement of the parts of the sheet cassette 61 and the parts of the main body of the copier 500 when determining the push-in length, so that the detoured passage can be securely formed and occurrence of the problem in that the upper exterior rib 2*b* is contacted with the exterior rib-facing portion 102*a* can be prevented. In this sheet feeder 300, the length of the space 50 in the Y direction (i.e., the gap between the tip of the rib 2*a* and the surface of the exterior rib-facing portion 102*a* in FIG. 1) is set to a length of from 2.0 mm to 3.0 mm. In addition, the length of the space 50 in the Z direction is also set to a length of from 2.0 mm to 3.0 mm.

When the sheet cassette 61 is detached from the copier 500, the sheet cassette 61 is pulled from the front side of the copier 500. Therefore, when there is a gap between the cassette exterior cover 1 and another exterior cover, there is a risk such that sounds leak from the gap, resulting in generation of noise for the users. In the sheet feeder 300 of this disclosure, the gap between the cassette exterior cover 1 and the openable and closable front cover 101 (i.e., a gap G1 in FIG. 1) is communicated with the space 50, and therefore sounds generated in the sheet feeder 300 cannot leak from the gap G1 without passing through the space 50. In addition, since the space 50 has a labyrinth structure, the sounds generated in the sheet feeder 300 decay in the space 50, and therefore leakage of the sounds from the copier 500 as a noise can be prevented even when the gap G1 between the cassette exterior cover 1 and the openable and closable front cover 101 is present on the front side of the copier 500.

Among the sounds generated in the copier 500, the sounds, which are caused by feeding the recording sheet P and which include the above-mentioned recording sheet feeding sound generated in the sheet feeder 300, have a great contribution rate. In the copier 500 according to an embodiment of this disclosure, leakage of the recording sheet feeding sound generated in the sheet feeder 300 can be minimized, and therefore the quietness of the copier 500 can be enhanced.

When the sheet cassette 61 is pulled from the main body of the copier 500, the sheet feeding roller 62 is also pulled therefrom in combination with the sheet cassette. Therefore, as illustrated in FIG. 6, the upper edge of the sheet cassette installation space 61*c*, into which the sheet cassette 61 is inserted and which is formed by the inner cover 102, has a recessed portion extending upward to prevent the sheet feeding roller 62 from contacting with the inner cover 102 when the attaching and detaching of sheet cassette 61 is performed. In this regard, the exterior rib 2 is not formed on a portion of the cassette exterior cover 1 facing the recessed portion of the inner cover 102, and therefore the detoured passage is not formed therebetween. Even in this case, in which the detoured passage is not necessarily formed in the entire space of the sheet feeder 300, which space is formed by the cassette exterior cover 1 and the parts forming the sheet container installation space 61*c* and which is located above the sheet pickup position E, a satisfactory sound leakage preventing effect can be produced. However, by forming the detoured passage in the entirety of the space of the sheet feeder, which space is formed by the cassette exterior cover 1 and the parts forming the sheet container installation space 61*c* and which is located above the sheet pickup position E, the sound leakage preventing effect can be enhanced.

As illustrated in FIGS. 1, 5A and 5B, in the sheet feeder 300, a detoured passage is not formed at a lower portion of the cassette exterior cover 1, which extends downward from the cassette bottom plate 61*a*.

As mentioned above, the length of the space 50 is set to a length of from 2.0 mm to 3.0 mm. However, due to production errors of the parts and assembly errors of the parts, the length of the space 50 varies within the margin of errors. Therefore, it is preferable that parts having high accuracy are assembled with high accuracy to produce the sheet feeder 300 and the copier 500 so that the exterior rib-facing portion 102*a* surrounds the upper exterior rib 2*a* from three directions, and the tip of the exterior rib-facing portion 102*a* is located between the upper exterior rib 2*a* and the lower exterior rib 2*b*.

When such a detoured passage as requested to have a high accuracy is formed above and below the sheet cassette 61, it is necessary to use parts having higher accuracy and to assemble the parts with higher accuracy. In this regard, when the accuracy is low, there is a possibility for a sheet feeder having two detoured passages (i.e., upper and lower detoured passages) that even when one of the upper and lower detoured passages can be formed, a problem such that parts forming the other detoured passage are contacted with each other and the sheet cassette cannot be inserted to the main body of the copier (the sheet container installation space 61*c*) occurs. Therefore, in order that parts having higher accuracy are assembled with higher accuracy to securely form such detoured passages above and below the sheet cassette 61, the manufacturing cost seriously increases.

In contrast, the sheet feeder 300 of this disclosure has a detoured passage above the sheet cassette 61 and no detoured passage below the sheet cassette. Therefore, increase of the manufacturing cost can be prevented.

As illustrated in FIGS. 1 and 5B, in the sheet feeder 300, a lower end portion 1*e* of the cassette exterior cover 1, which extends downward from the cassette bottom plate 61*a* (which is the lower edge of the sheet cassette 61), contacts the lower frame 5. Therefore, even when a detoured passage is not formed below the sheet cassette 61, leakage of sounds from a portion of the copier 500 located below the sheet cassette 61 can be prevented.

As mentioned above, since sounds generated at the sheet pickup position E hardly travel downward, a space having no detoured passage can be formed between the lower portion of the cassette exterior cover 1 and the lower frame 5 because sounds hardly leak from the portion of the copier 500 located below the sheet cassette 61. When such a space is formed, the sheet cassette 61 and the main body of the copier 500 can have a play, and therefore the attaching and detaching operability of the sheet cassette 61 can be enhanced.

In the sheet feeder 300, the inner cover 102, which is one of parts forming the sheet container installation space 61*c* and which separates the inside of the sheet feeder from the outside thereof, forms the detoured passage. By forming the external rib-facing portion 102*a*, which includes a wall extending in a direction perpendicular to the surface of the inner cover 102, a detoured passage can be formed while reinforcing the inner cover 102.

In addition, in the sheet feeder 300, the space 50 communicates with the gap G1 between the cassette exterior cover 1 and the openable and closable front cover 101, and the openable and closable front cover 101 forms part of the detoured passage, thereby making it possible to complicate the structure of the detoured passage, resulting in enhancement of the sound leakage preventing effect. Thus, the openable and closable front cover 101 also serves as a part of the sheet feeder (i.e., a passage forming member or a sheet container installation space forming member).

As mentioned above, the openable and closable front cover 101 serves as a part forming the detoured passage. Thus, even such an openable and closable cover can also be used for forming the detoured passage in this sheet feeder 300.

As illustrated in FIGS. 5A and 5B, the exterior rib-facing portion 102*a* is arranged at a location such that the exterior rib-facing portion 102*a* does not interfere with attachment of the sheet cassette 61 to the main body of the copier 500 and detachment of the sheet cassette from the main body (i.e., insertion of the sheet cassette to and extraction of the sheet cassette from the sheet container installation space 61*c*). Therefore, the exterior rib-facing portion 102*a* can form the detoured passage without interfering with the recording sheet setting operation.

Since the copier 500 (i.e., the image forming apparatus according to an embodiment of this disclosure) uses the sheet feeder 300 as a sheet feeder to feed the recording sheet P to the image forming portion 100, sounds generated in the sheet feeder 300 hardly leak from the copier 500.

Figure 7A:
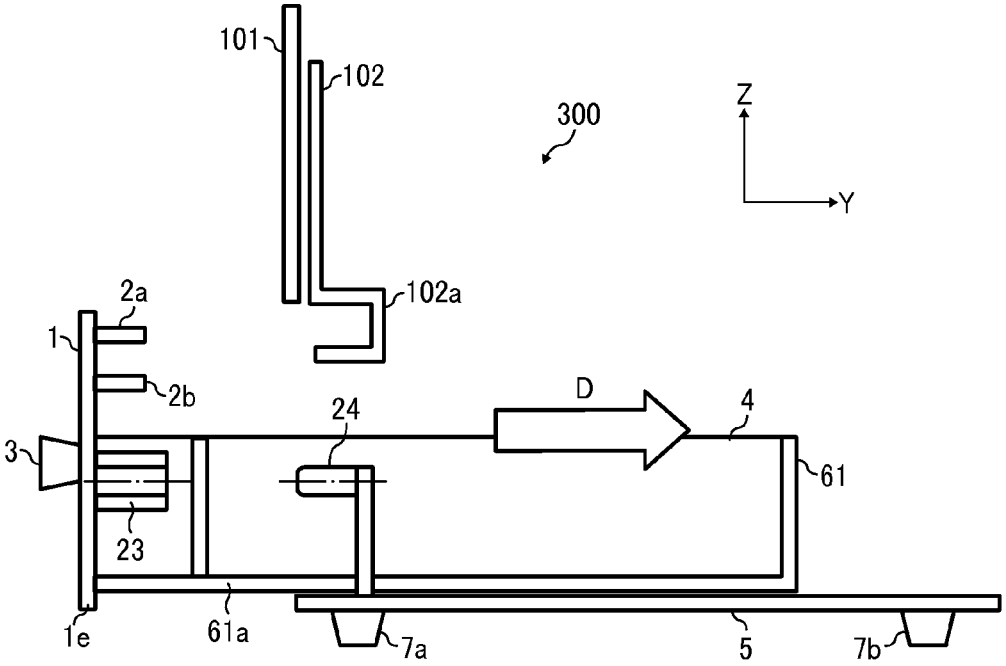
FIG. 7A is a schematic side view illustrating another sheet feeder, which is equipped with positioning members.
Figure 7B:
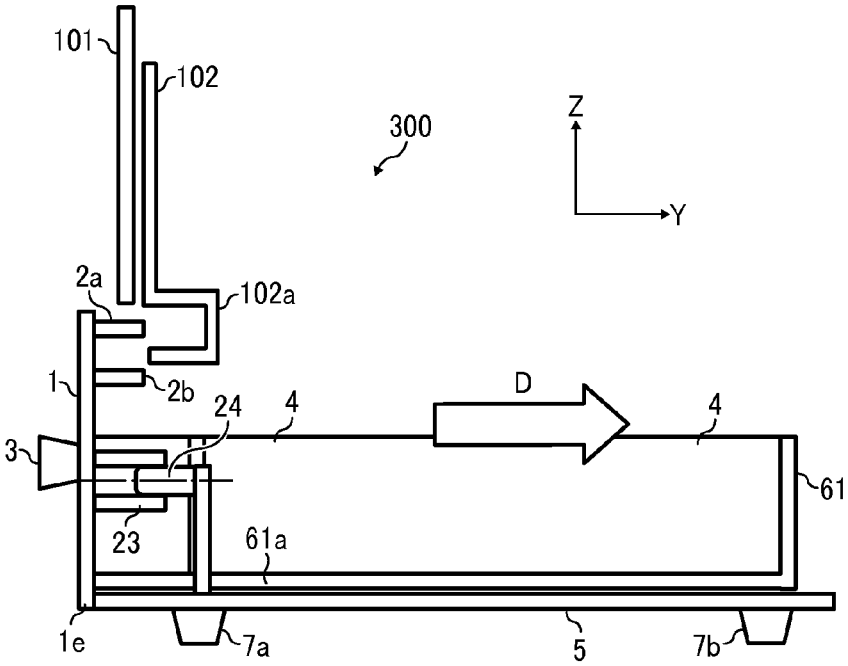
FIG. 7B is a schematic side view illustrating the sheet feeder whose positioning members start to be engaged with each other.

FIGS. 7A and 7B are schematic side views illustrating another sheet feeder, which includes a positioning member to properly position the sheet cassette 61 relative to the main body of the copier 500. FIG. 7A is a schematic side view illustrating the sheet cassette 61, which is in the process of insertion into the main body of the copier 500 (i.e., the sheet container installation space 61*c*), and FIG. 7B is a schematic side view illustrating the sheet cassette 61, in which positioning members start to be engaged with each other.

The sheet feeder 300 illustrated in FIGS. 7A and 7B includes a cassette-side positioning member 23 (hereinafter referred to as a first positioning member), which is arranged on the cassette exterior cover 1, and a main body-side positioning member 24 (hereinafter referred to as a second positioning member), which is arranged on the lower frame 5 of the main body of the copier 500.

When the sheet cassette 61 is inserted into the main body of the copier 500 (i.e., the sheet container installation space 61*c*), the inner cover 102 and the cassette exterior cover 1 form the labyrinth structure. In this regard, as illustrated in FIG. 7B, the sheet cassette 61 is positioned relative to the main body of the copier 500 by the first and second positioning members 23 and 24 before the exterior rib-facing portion 102*a* overlaps with the exterior ribs 2*a* and 2*b*, thereby making it possible to prevent the exterior ribs 2*a* and 2*b* from striking the inner cover 102 due to miss-positioning of the sheet cassette 61 relative to the main body when the sheet cassette is inserted into the main body.

The copier 500 according to an embodiment of this disclosure includes the image forming portion 100 and the sheet feeder 300, which are integrated as a single unit. However, the image forming apparatus of this disclosure is not limited thereto, and can have a configuration such that an image forming portion (such as the image forming portion 100) and a sheet feeder (such as the sheet feeder 300) are combined with each other. In addition, the sheet feeder of this disclosure is not limited to the sheet feeder 300 mentioned above, and can be an optional sheet feeder, which can be optionally attached to the copier 500, for example, at a location below the sheet feeder 500. Namely, such a sheet feeder can be used as a device independent from the image forming portion.

In addition, the sheet container installation space forming member (such as the covers 101, 102, and lower frame 5) can belong to the sheet feeder 300 or the copier 500.

The sheet feeding device is not limited to a roller such as the sheet feeding roller 62, and other devices such as endless belts, which can apply a feeding power to a recording sheet by contacting the recording sheet, can also be used therefor.

The sheet feeder and the copier mentioned above are examples of the sheet feeder and the image forming apparatus of this disclosure, and this disclosure includes the below-mentioned embodiments which produce specific effects as mentioned below.

Embodiment A

The sheet feeder according to Embodiment A includes a sheet container installation space forming member (such as the front cover 101, the inner cover 102, and the lower frame 5), which forms a sheet container installation space (such as the sheet container installation space 61*c*) in the sheet feeder or a main body of an image forming apparatus; a sheet container (such as the sheet cassette 61), which is inserted into or extracted from the sheet container installation space; and a sheet feeding device (such as the sheet feeding roller 62), which contacts with a recording sheet (such as the recording sheet P) in the sheet container at a sheet pickup position to apply a feeding power to the recording sheet, wherein a passage, which is formed by the sheet container installation space forming member and the sheet container and which communicates the inside of the sheet feeder (or the image forming apparatus) with the outside thereof, is detoured plural times (such as the above-mentioned passage detoured plural times), and is located above the sheet pickup position at which sounds are generated.

Since the sheet feeder has such a configuration, the sounds generated from the sound source of the sheet feeder can be effectively prevented from leaking by the detoured passage. The reason therefor is the following.

Specifically, the sounds generated in the sheet feeder are mainly a rubbing sound generated when the sheet feeding device is contacted with the recording sheet to apply a feeding power thereto. The rubbing sound is generated on the surface of the recording sheet, and transmission of the rubbing sound downward from the sound source is prevented by the recording sheets on the sheet container. Therefore, even when a passage (lower passage) which communicates the inside of the sheet feeder (or the image forming apparatus) with the outside thereof via a gap (such as a gap G2 illustrated in FIG. 1) between the sheet container and the sheet container installation space forming member is present below the sound source, the sounds generated by the sound source hardly leak from the inside of the sheet feeder (or the image forming apparatus) to the outside thereof through the passage. Even when such a lower passage, through which sounds hardly leak, is detoured plural times, a good sound leakage preventing effect, which is worth the cost of making the lower detoured passage, cannot be produced.

In contrast, there is no recording sheet above the sound source, and therefore transmission of sounds cannot be prevented. Therefore, when a passage which communicates the inside of the sheet feeder (or the image forming apparatus) with the outside thereof via a gap (such as the gap G1 illustrated in FIG. 1) between the sheet container and the sheet container installation space forming member is present above the sound source, the sounds easily leak from the inside of the sheet feeder (or the image forming apparatus) to the outside thereof through the passage. Therefore, in Embodiment A, a passage detoured plural times is formed above the sound source to effectively prevent the sounds generated by the sound source of the sheet feeder from leaking from the inside of the sheet feeder (or the image forming apparatus) to the outside thereof.

In this regard, the detoured passage means a passage bent at an angle (such as the passage in the space 50 illustrated in FIG. 1) or a curved passage, which is formed between two points although the points can be communicated with each other by a straight passage. Namely, sounds cannot travel linearly in the detoured passage, and detour therein. In the sheet feeder 300 illustrated in FIG. 1, the passage is bent at a right angle plural times. However, the detoured passage is not limited thereto. For example, the detoured passage can be a passage curved plural times.

Embodiment B

The sheet feeder of Embodiment B is characterized in that, in the sheet feeder of Embodiment A, a passage detoured plural times is not formed on a lower portion (such as the cassette exterior cover 1) of the sheet feeder, which portion is located below the sheet container.

The sheet feeder of Embodiment B has an advantage such that increase of the manufacturing cost can be prevented as mentioned above.

Embodiment C

The sheet feeder of Embodiment C is characterized in that, in the sheet feeder of Embodiment A or B, a portion of the sheet container projecting downward from the lower surface of the sheet container (such as a lower portion 1*e* of the cassette exterior cover 1) is contacted with a member (such as the lower frame 5), which forms the lower edge of the sheet container installation space.

The sheet feeder of Embodiment C has an advantage such that even when a passage detoured plural times is not formed on a lower portion of the sheet container, leakage of sounds from the lower portion of the sheet container can be prevented as mentioned above.

Embodiment D

The sheet feeder of Embodiment D is characterized in that, in the sheet feeder of any one of Embodiments A, B and C, the sheet feeder includes a sheet container exterior cover (such as the cassette exterior cover 1), which covers the front surface of the sheet container relative to the sheet container detaching direction, and the detoured passage is formed between the sheet container exterior cover and the sheet container installation space forming member (such as the inner cover 102), which forms an edge of the sheet container installation space. In this regard, a rib (such as the upper and lower exterior ribs 2*a* and 2*b*) is formed on the sheet container exterior cover while extending in the sheet container attaching direction to form the detoured passage.

The sheet feeder of Embodiment D has an advantage such that as mentioned above the rib reinforces the sheet container exterior cover while forming the detoured passage, and the manufacturing cost can be reduced so as to be lower than in a case in which a rib is formed for reinforcing the cassette exterior cover 1 and another rib is formed for forming the detoured passage.

Embodiment E

The sheet feeder of Embodiment E is characterized in that, in the sheet feeder of Embodiment D, the rib includes upper and lower ribs (such as the upper and lower exterior ribs 2*a* and 2*b*), wherein the lower rib is longer in the sheet container attaching direction than the upper exterior rib.

The sheet feeder of Embodiment E has an advantage such that as mentioned above by elongating the rib closer to the sheet container (such as the sheet cassette 61), which has a sound source, sounds can be securely diffracted (and reflected), and thereby the sound decaying effect caused by diffraction (and reflection) can be enhanced.

Embodiment F

The sheet feeder of Embodiment F is characterized in that, in the sheet feeder of any one of Embodiments A to E, the sheet container (such as the sheet cassette 61) or a part fixed to the sheet container (such as the cassette exterior cover 1) and the sheet container installation space forming member form the detoured passage, and the sheet container installation space forming member includes a space forming cover (such as the inner cover 102), which separates the inside of the sheet feeder (or the image forming apparatus) from the outside thereof.

The sheet feeder of Embodiment F has an advantage such that as mentioned above the detoured passage can be formed while reinforcing the space forming cover.

Embodiment G

The sheet feeder of Embodiment G is characterized in that, in the sheet feeder of Embodiment F, the space forming cover includes plural space forming covers (such as the front openable and closable cover 101 and the inner cover 102).

The sheet feeder of Embodiment G has an advantage such that as mentioned above the structure of the detoured passage can be further complicated, and thereby the sound leakage preventing effect can be enhanced.

Embodiment H

The sheet feeder of Embodiment H is characterized in that, in the sheet feeder of Embodiment F or G, one of the plural space forming covers is an openable and closable cover (such as the openable and closable front cover 101) which can be opened or closed relative to the main body of the image forming apparatus.

The sheet feeder of Embodiment H has an advantage such that as mentioned above such an openable and closable cover can be used for forming the detoured passage.

Embodiment I

The sheet feeder of Embodiment I is characterized in that, in the sheet feeder of any one of Embodiments A to H, the sheet container (such as the sheet cassette 61) or a part fixed to the sheet container (such as the cassette exterior cover 1) and the sheet container installation space forming member (such as the inner cover 102) form the detoured passage, and the push-in length of the passage forming member of the sheet container (such as the rib 2*a*), which forms the detoured passage, is less than the length of a space (such as the space 50) formed by the sheet container installation space forming member (such as the exterior rib-facing portion 102*a*), which also forms the detoured passage. In this regard, the push-in length is defined as follows. Specifically, when the sheet container is inserted into the sheet container installation space (or the main body of the image forming apparatus) by a press force, the tip of the part of the sheet container forming the detoured passage moves to an inner position by a certain length, wherein the certain length is defined as the push-in length. Namely, even when the sheet container is inserted into the sheet container installation space (or the main body of the image forming apparatus) by a press force, the part of the sheet container forming the detoured passage does not strike the member forming the sheet container installation space.

The sheet feeder of Embodiment I has an advantage such that as mentioned above even when the parts vary in size and the sheet container is pushed by the push-in length, occurrence of problems such that the desired detoured passage cannot be formed or the sheet container strikes the sheet container installation space forming member (or the main body of the image forming apparatus) forming the detoured passage can be prevented.

Embodiment J

The sheet feeder of Embodiment J is characterized in that in the sheet feeder of any one of Embodiments A to I, the sheet feeder further includes a positioning member (such as the first and second positioning members 23 and 24) which positions the sheet container exterior cover (such as the cassette exterior cover 1) to the sheet container installation space forming member (or the main body of the image forming apparatus) when the sheet container is completely inserted into the sheet container installation space forming member (or the main body of the image forming apparatus).

The sheet feeder of Embodiment J has an advantage such that as mentioned above the positioning member prevents the part of the sheet container exterior cover (such as exterior ribs 2*a* and 2*b*) from striking the sheet container installation space forming member (such as the inner cover 102) or the main body of the image forming apparatus.

Embodiment K

The sheet feeder of Embodiment K is characterized in that in the sheet feeder of any one of Embodiments A to J, the sheet container installation space forming member (such as the exterior rib-facing portion 102*a*) is located at a position such that attachment and detachment of the sheet container (such as the sheet cassette 61) is not interfered by the member.

The sheet feeder of Embodiment K has an advantage such that as mentioned above the edge of the inner cover 102 can form the detoured passage without interfering the sheet container attaching and detaching operation.

Embodiment L

The image forming apparatus of Embodiment L (such as the copier 500) includes an image forming portion (such as the image forming portion 100) to form an image on a recording sheet (such as the recording sheet P), and a sheet feeder to feed the recording sheet to the image forming portion. The sheet feeder is the sheet feeder of any one of Embodiments A to K.

The image forming apparatus of Embodiment L has an advantage such that sounds generated in the sheet feeder can be prevented from leaking from the image forming apparatus as mentioned above.

Effect of this Disclosure

As mentioned above, the sheet feeder of this disclosure can produce a good sound leakage preventing effect using a passage detoured plural times while maintaining good sheet tray attaching and detaching operability.

Additional modifications and variations of the present invention are possible in light of the above teachings. It is therefore to be understood that within the scope of the appended claims the invention may be practiced other than as specifically described herein.

What is claimed is:

1. A sheet feeder comprising:

a sheet container configured to store recording medium therein, the sheet container including a front wall, a rear wall and a bottom surface connected therebetween, the front wall having at least two first projections projecting therefrom towards the rear wall, the at least two first projections including a top projection and a bottom projection forming a first receiving space therebetween; and a housing configured to receive the sheet container, the housing having a second projection projecting therefrom, the second projection having a top portion and a bottom portion forming a second receiving space such that, when the sheet container is inserted in the housing, the bottom portion of the second projection is configured to enter the first receiving space and the top projection of the at least two first projections is configured to enter the second receiving space to form a labyrinth passage between an inside of the housing and an outside of the housing.

2. The sheet feeder of claim 1, further comprising:

a sheet feeding device configured to feed the recording medium to an image forming device, the sheet feeder configured to reduce a level of sound reaching the outside through the passage while the sheet feeding device feeds the recording medium.

3. An image forming apparatus comprising:

an image forming device; and the sheet feeder of claim 1, the sheet feeder configured to feed the recording medium to the image forming device.

* * * * *